US005624096A

United States Patent [19]

Haynes

[11] Patent Number: 5,624,096

[45] Date of Patent: Apr. 29, 1997

[54] BOOK SUPPORT APPARATUS

[76] Inventor: Debra Haynes, 943 Dogwood, Costa Mesa, Calif. 92627

[21] Appl. No.: 600,299

[22] Filed: Feb. 12, 1996

[51] Int. Cl.[6] ..... A47B 97/04

[52] U.S. Cl. ..... 248/451; 248/454

[58] Field of Search ..... 248/451, 454, 248/460, 444.1, 165; 211/42, 43

[56] References Cited

U.S. PATENT DOCUMENTS

| | | | |
|---|---|---|---|
| 2,546,283 | 3/1951 | Webster | 248/441.1 X |
| 2,759,454 | 8/1956 | Swart | 248/460 X |
| 2,908,465 | 10/1959 | Lykes | 248/451 X |
| 3,476,348 | 11/1969 | Rustad | 248/451 X |
| 4,119,289 | 10/1978 | Kanocz | 248/454 |
| 4,159,836 | 7/1979 | Tarr | 248/444.1 X |
| 4,191,354 | 3/1980 | Chia-Liu | 248/451 X |
| 4,313,589 | 2/1982 | Vega | 248/558 |
| 4,378,102 | 3/1983 | Portis, Jr. et al. | 248/460 |
| 4,596,372 | 6/1986 | Ford | 248/444.1 |
| 4,726,556 | 2/1988 | Weir | 248/454 |
| 4,848,710 | 7/1989 | Newman | 248/441.1 X |
| 5,129,616 | 7/1992 | Carson | 248/457 |
| 5,139,222 | 8/1992 | Koorey et al. | 248/311.2 |
| 5,328,143 | 7/1994 | Koorey et al. | 248/311.2 |
| 5,393,030 | 2/1995 | Tarozzi | 248/460 |
| 5,407,158 | 4/1995 | Baird | 248/224.8 X |

*Primary Examiner*—Ramon O. Ramirez
*Assistant Examiner*—Stephen S. Wentsler
*Attorney, Agent, or Firm*—Gene Scott - Patent Law & Venture Group

[57] ABSTRACT

A book support device having a supporting device with an approximately vertical and an approximately horizontal support surfaces and a mounting device having a downfacing rest edge that extends downwardly from the horizontal support surface. The rest edges may be positioned in contact with a horizontal rest surface, such as a bed, so as to stabilize the book above the surface, or the mounting device may be removably engaged with a pair of support bases having two vertically oriented support arms interconnected to one another by a horizontal portion so as to increase the elevation of the supporting device and book with respect to the horizontal rest surface on which the book support rests. The invention also includes a device for retaining the book in an open position, a device for adjusting the inclination at which the support device is positioned, and a device for magnifying the printed matter of the book.

9 Claims, 4 Drawing Sheets

BOOK SUPPORT APPARATUS

BACKGROUND OF THE INVENTION

1. Field of the Invention

This invention relates generally to a book support apparatus, and more particularly to an improved support apparatus capable of retaining a book in an open position, magnifying printed matter of the book and storing a plurality of books in a convenient and easily accessible location.

2. Description of Related Art

Holding a book and maintaining it in an open position while reading is often a cumbersome and tedious procedure, especially when reading for an extended period of time. In addition to causing the reader's hands, wrists and arms to tire, holding a book in such a position ties up at least one of the reader's hands, thus typically preventing the reader from completing any other tasks, such as eating, drinking, taking notes, and so on, while reading. These and other problems associated with holding a book while reading are especially acute when the reader attempts to, or by necessity, reads while seated or lying in bed.

As a result, a variety of different book support apparatus have been designed to remedy these problems. For example, Vega U.S. Pat. No. 4,313,589 and Webster U.S. Pat. No. 2,546,283 disclose desk-like apparatus for supporting reading materials. Both devices consist of a generally vertically oriented support means on which a book rests, and two approximately L-shaped support stands, positioned on either side of the support means. The horizontal arm of each support stand is designed to rest in contact with a bed or other such, generally horizontal, rest surface on which the reader is positioned, while the vertical arm of each support stand serves to elevate the support means above the bed's surface so that the reader's legs may be comfortably positioned beneath the support means and between the support stands. Unfortunately, both of these apparatus are large and bulky in construction, and cannot be folded into a more compact unit when not in use. Still further, neither of these devices allow for the angle of incline of the support means, and thus the book, to be adjusted, thus limiting these devices for use when a reader is restricted to certain body orientations or positions, such as would be the case for the infirm.

Carson U.S. Pat. No. 5,129,616 and Kanocz U.S. Pat. No. 4,119,289 both disclose collapsible book support apparatus that can be easily folded into a compact unit for convenient storage of the device when not in use. In addition, each of these apparatus provide means by which to adjust the inclination of the support means, and thus the angle at which the book faces the reader, so that the reader may adjust the apparatus when his or her body position is changed. However, the support stands of each of these devices are relatively flimsy and unstable, thus making the device more prone to being damaged. Still further, the support stands of these devices have a two-legged construction in which the legs extend downwardly from the support means and terminate with relatively small feet which rest on the bed surface. This is undesirable in that local depressions in the bed surface or its coverings can result in an unstable or tilted book support surface. Also, the legs of these devices are somewhat flimsy and thus subject to being easily broken.

All of the above detailed devices are also significantly flawed in that they do not provide means by which to maintain a book in the open position. This is a significant disadvantage, as the reader must therefore still constantly keep at least one hand in contact with the book to keep it open while reading. Still further, none of the above detailed prior art devices are capable of being used without the support stand that elevates the book, thus making such apparatus ineffective when the reader is in a position other than lying or sitting in bed.

Portis, Jr. et al. U.S. Pat. No. 4,378,102 discloses an apparatus having a relatively thin, flat support means and two V-shaped support stands having one leg of each support stand longer than the other. An elongate slot is positioned in the end of each of the arms, and a corresponding slot is positioned near the side edges of each of the support means. In use, one arm of each support stand is positioned against the bed surface, while the other arm of each stand extends angularly upwardly from the bed surface. The slots in the upwardly extending support stand arms are engaged with the corresponding slots in the support means, thus securing the support means and the book at an elevated angle from the bed so that the book can be easily read from a seated position. In addition, a series of slots are positioned in a downfacing edge of the support means, while two lines are secured, at one end, to the upfacing edge of the support means and weights are secured to the other end of the lines. When it is desired to hold a book open to a particular page, the lines are simply positioned over the book and into one of the slots in the downfacing edge, the weights causing the lines to be pulled taut across the book's pages, thereby maintaining it in an open position. The height at which the support means and book are elevated can be easily adjusted by alternately interconnecting the slots of the long arms or short arms of the V-shaped support stands with the support means.

Unfortunately, this apparatus provides no means by which to adjust the inclination at which the support means and book are positioned. This is a significant limitation, as it makes the book difficult to properly view when a reader is positioned in any position other than an upright, seated position. In addition, while this apparatus is partially collapsible in that the support stands can be disengaged from the support means when the device is no longer in use, the V-shaped stands cannot be folded into a more compact manner, thus making the device ungainly to store.

Thus there is a clear need for an improved book support apparatus that is fully adjustable so that it can be utilized when the reader is in any number of sitting or lying positions and fully collapsible so that it can be conveniently and easily stored when it is not in use. Such an improved book support apparatus would also include a means by which to retain a book in an open position. Further, such a book stand would be made in a highly automatic fabrication method for ease and economy of manufacture. The present invention fulfills these needs and provides further related advantages as described in the following summary.

SUMMARY OF THE INVENTION

The present invention is an improved book support apparatus that supports a book in an open position at a variety of different angles so that the book may be easily viewed by a reader who is sitting, standing or laying down without requiring the use of the reader's hands to support the book. Thus, it is a primary object of the present inventive book support apparatus to allow a reader free movement of both hands while reading. This not only allows the reader to perform other activities, such as eating or drinking, while reading, but it also prevents the reader's hands, wrists and arms from tiring from supporting the book.

The present invention is a book support system having a supporting means with an approximately vertical support surface formed integrally with and perpendicular to an approximately horizontal support surface. A mounting means having a downfacing rest edge extends downwardly from each side edge of the horizontal support surface. The rest edges may be positioned in contact with a horizontal rest surface, such as a bed, countertop, etc., so as to hold the book in a stable manner in a desired postition above the surface. A pair of U-shaped support bases having two vertically oriented support arms interconnected to one another by a horizontal portion can be easily interconnected with the mounting means so as to provide further stability to the support apparatus and raise the reading matter with respect to the horizontal rest surface on which the device rests. When the supporting means is secured to the support bases, the supporting means is elevated high enough that the reader's legs may be easily positioned beneath the supporting means and between the support bases. Thus it is an object of the present invention to provide a book support apparatus in which the height that the book is supported above the horizontal rest surface can be easily altered by simply engaging or disengaging the supporting means with the support bases. This allows the device to be conveniently positioned on a bed or chair when the supporting means is engaged with the support bases, and also on a countertop, table or desk when the supporting means is disengaged from the bases.

The supporting means and the support bases are engaged with one another in such a way that the angle at which the supporting means is secured above the horizontal rest surface may be quickly and easily adjusted. This allows the inclination of the book to be easily adjusted to accommodate the reader in either a seated or possibly a lying position.

The apparatus includes apertures positioned near opposing side edges of the vertical support surface of the supporting means. Elastic ties are secured through the apertures, and an elongate rod can be secured through these ties so as to be positioned firmly over the pages of the open book. Thus, it is another object of the present invention to provide a means for retaining the book in an open position so as to allow the reader even greater freedom of movement of the hands while reading.

The device also includes further apertures positioned near opposing side edges of the vertical support surface. A stand-off may be positioned in each of the apertures, and an elongate magnifying device may be secured to the stand-offs so as to extend across the open book. Thus it is an object of the present invention to provide a magnifying lens that can be easily positioned and automatically maintained at an appropriate distance from the book without requiring that the user manually hold the lens in place.

It is yet another object of the present invention for the U-shaped construction of the support bases to provide a convenient storage area in which a plurality of books or other such items may be stacked and stored between the vertical arms of the bases.

It is another object of the present invention to provide an apparatus that is easily disassembled and which may be compactly positioned for convenient storage of the device in a small area, such as under a bed or in a closet. The arms of one of the support bases are designed to fit within the arms of the other support base so that the two bases can be slid together and the supporting means can be slid between the arms of the two interengaged bases. In addition, an opening is preferably provided near a top edge of the vertical support surface so as to provide a handle by which to hold and carry the supporting means.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention, a device for holding a book in an upright manner as for reading in bed, on a counter top, and the like. In such drawings.

DETAILED DESCRIPTION OF THE PREFERRED EMBODIMENT

Figure 2:
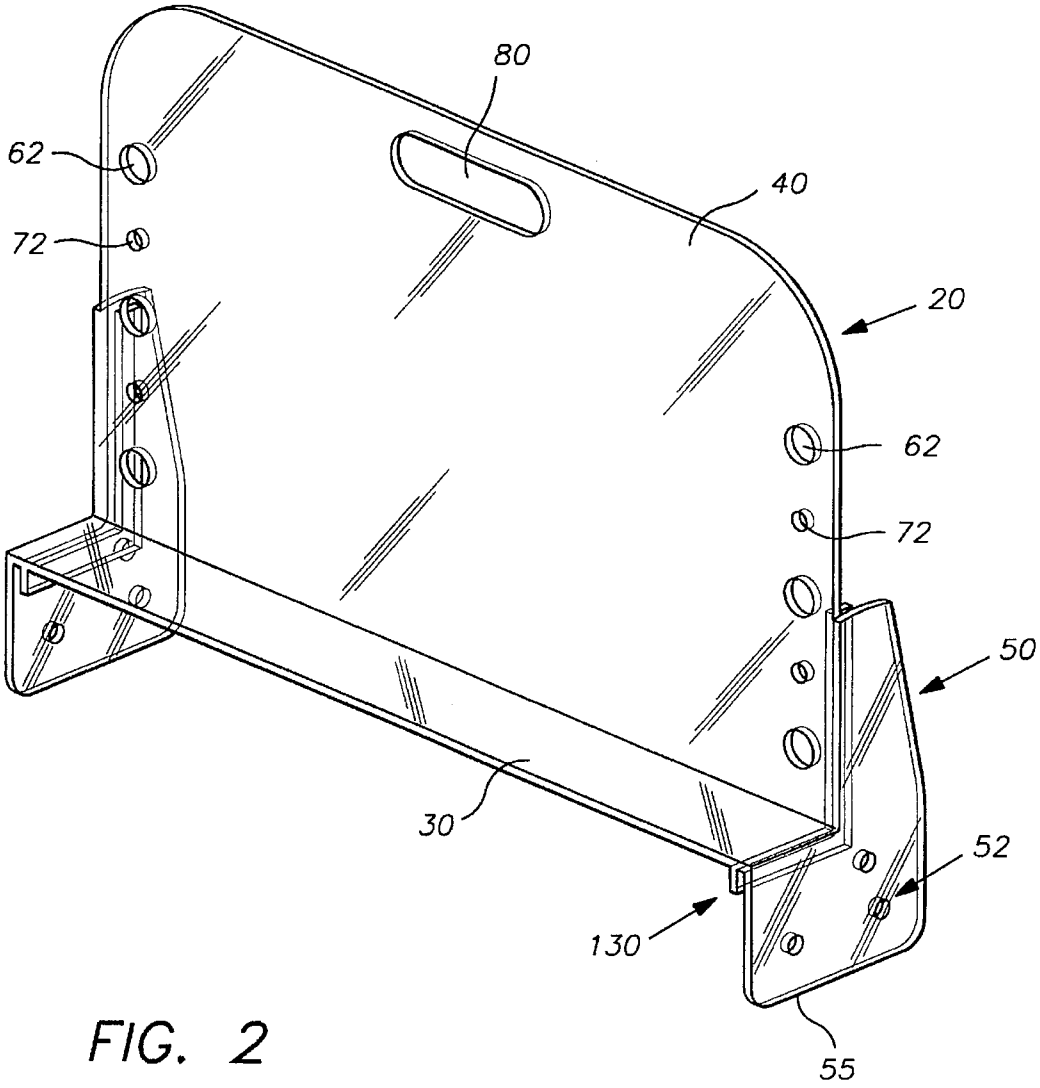
FIG. 2 is a perspective view thereof, particularly showing the book support portion as used alone supported on any flat surface.

The above described drawing figures illustrate an apparatus for supporting a book 5. The apparatus is preferably constructed of a lightweight, durable, transparent sheet material such as acrylic plastic. The apparatus has a means for supporting a book 20 that comprises a first, near horizontal, and a second, near vertical, supporting surfaces, 30 and 40 respectively, for supporting the book 5. In one preferred embodiment, (not shown) the vertical supporting surface 40 is partly or fully mirrored, so as to be clearly visible to a reader facing a book. The supporting means 20 also includes a pair of mounting means 50 for mounting the book supporting means 20. The mounting means 50 are positioned in a mutually spaced apart relationship and each extends downwardly from opposing sides of the near horizontal supporting surface 30 and terminates in a downwardly facing rest edge 55, see FIG. 2. When the rest edges 55 of the mounting means 50 are positioned in contact with a flat support surface (not shown), such as that of a countertop, desk or table, the apparatus is able to support a book 5 with stability on the flat support surface, as illustrated in FIG. 2.

The near vertical supporting surface 40 provides a means 60 for holding the book 5 in an open state. There are many different embodiments of the means 60 for holding the book in an open state that may successfully be implemented within the present invention. In one preferred embodiment, illustrated in FIG. 1, the means 60 for holding the book 5 in an open state comprises at least one pair of horizontally spaced apart first apertures 72 positioned near opposing side edges 42 of the vertical supporting surface 40 of the book supporting means 20, at least one pair of elastic ties 68 engaged in the first apertures 72 and a means for page pressing 64, removably engageable with the ties 68. In this embodiment, the page pressing means 64 consists of a flexible elongate, preferably transparent, rod that is positioned across the open pages of the book 5 and engaged with the elastic ties 68 in the spaced apart first apertures 72, the ties 68 thus holding the pressing means 64 firmly in place against the pages of the book 5 so as to retain the book 5 in the open position with the pages pressed, more or less, flat.

Figure 4:
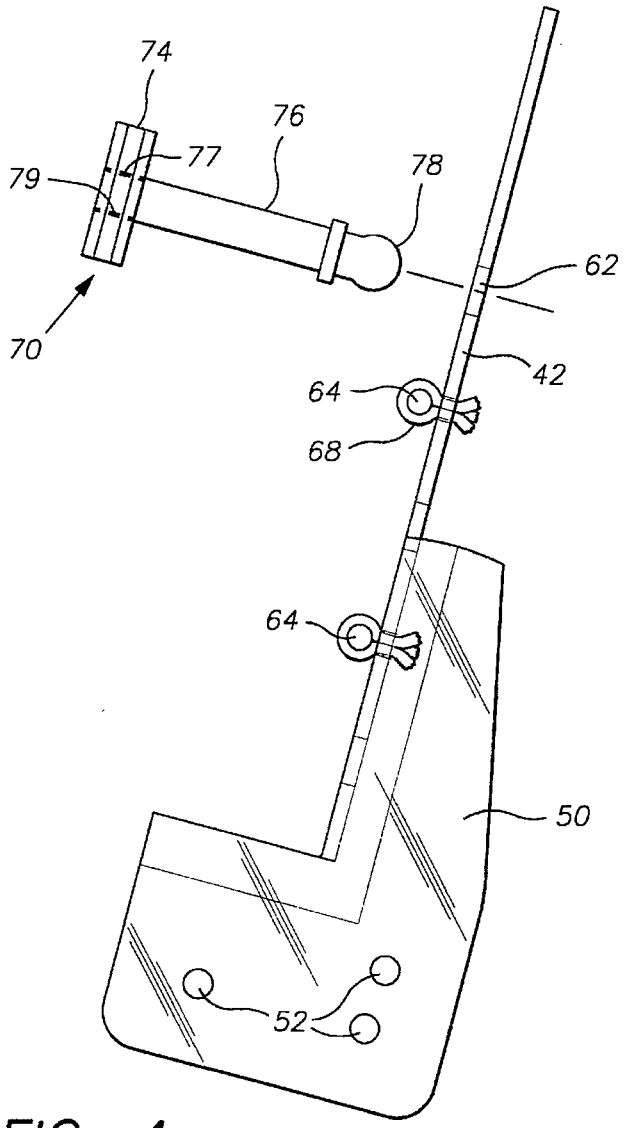
FIG. 4 is a side elevational view of the book support portion, particularly showing a reading magnifier and means for adjustable mounting of same, and, further, means for holding a book in the open orientation.
Figure 5:
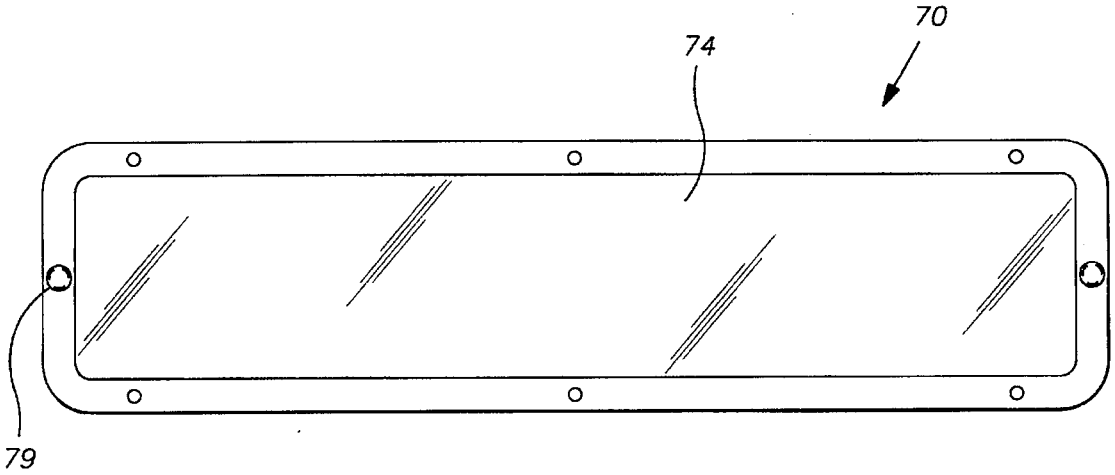
FIG. 5 is a front elevational view of the reading magnifier of the invention.

A means for magnifying 70 (FIG. 5) the printed matter of the book 5 to a reader (not shown) positioned in front of the book 5 is an important part of the present invention. The magnifying means 70 includes at least one pair of spaced apart second apertures 62 positioned near the opposing side edges 42 of the vertical supporting surface 40, at least one pair of stand-offs 76, and an elongate magnifying lens 74 extending between the spaced apart second apertures 62. The magnifying lens 74 is preferably a flat Fresnel lens, although there are many other types of lenses well known in the art that may also be implemented within the present inventive magnifying means 70. One end 77 of each stand-off 76 is either affixed to or removably engaged with the magnifying lens 74, and the other end 78 of each stand-off 76 is designed to be removably engaged with the second apertures 62. When the stand-offs 76 are properly positioned and engaged with an opposing pair of the second apertures 62 and the magnifying lens 74, the magnifying lens 74 is secured at an appropriate distance from the printed matter of the book 5 so as to allow for proper magnification of the printed matter, as clearly illustrated in FIG. 4. Preferably, the end 78 of each stand-off 76 is bulbous in shape so that it is engagable with the second apertures 62 by friction fit, thus allowing the stand-offs to be easily moved from one set of second apertures 62 to another set of the second apertures 62, for adjusting the vertical position of the magnifying lens 74 in front of the book 5. Note that the magnifying lens 74 is preferably assembled in a sandwich arrangement with a pair, front and rear, of frames, as best seen in FIGS. 4 and 5. Such an arrangement is preferably assembled by using peened plastic pegs to hold the frames and the lens together as a permanent assembly. Preferably, both the frames and lens are perforated at opposing sides with mounting holes 79 which accept corresponding stand-offs 76.

As seen in the drawings, the at least one pair of first and second apertures, 72 and 62 respectively, preferably consist of several pairs of apertures positioned in alignment along the length of, and near, the vertical support surface's side edges 42. This allows the position of both the page pressing means 64 and the magnifying lens 74 to be easily and quickly adjusted by the reader as desired.

Figure 1:
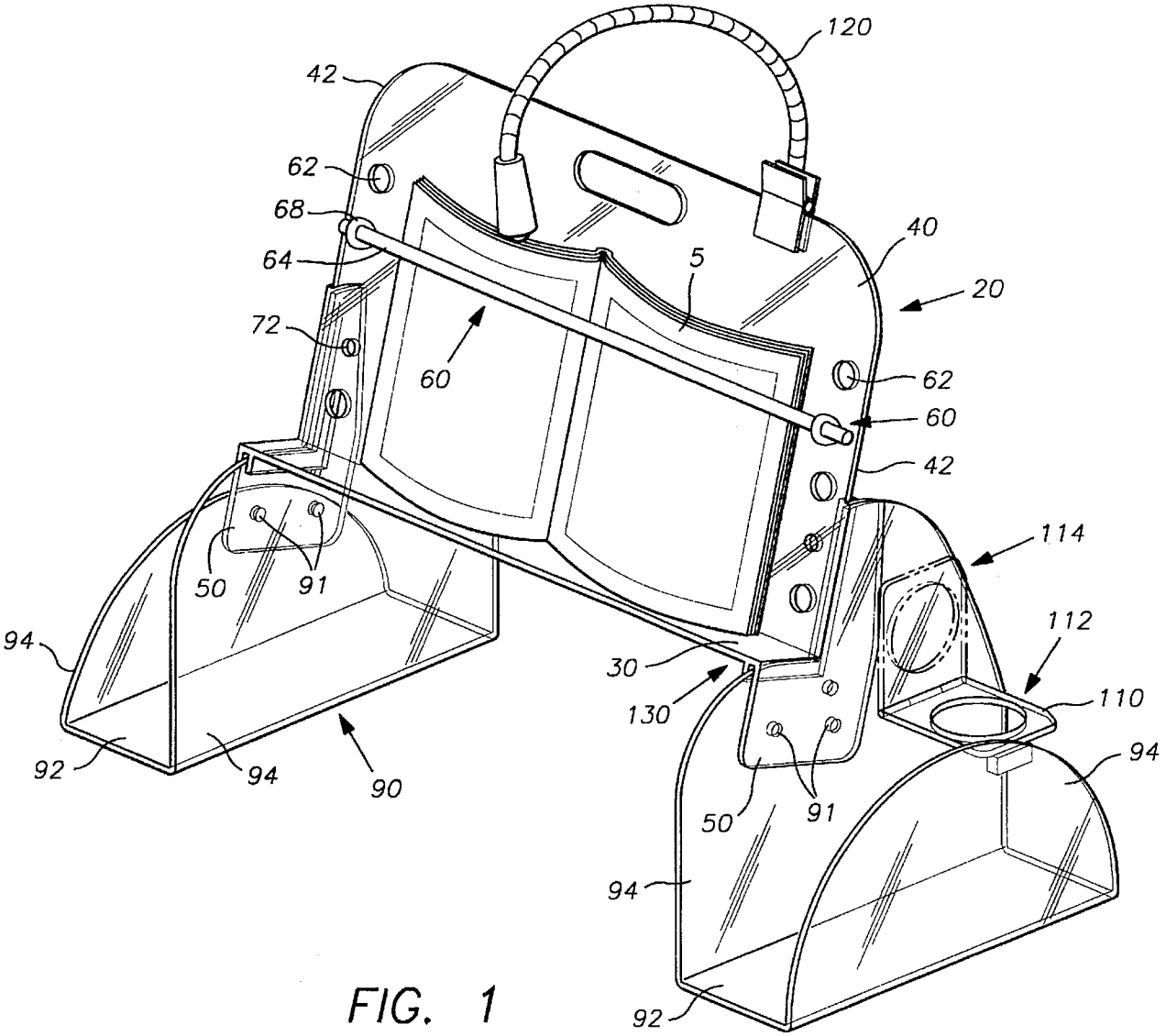
FIG. 1 is a perspective view of the preferred embodiment of the present invention, particularly showing a book support portion and two lateral bases.

As seen in FIG. 1, the apparatus further includes a pair of supporting bases 90 designed to engage with the supporting means 20 and further elevate the supporting means 20 and book 5 above the flat support surface on which the apparatus rests. Each of the bases 90 is preferably formed from a single, U-shaped sheet of material so as to have a flat horizontal portion 92 integrally formed with a pair of vertical, spaced apart, upwardly extending arms 94. The bases 90 provide means for dismountable engagement with the book supporting means 20, such that with the flat horizontal portions 92 of the bases 90 in resting contact with the flat support surface of a bed or the like, the book supporting means 20 is positioned above the flat support surface by an amount great enough to allow the horizontally positioned torso or legs of a person resting on the flat support surface to fit comfortably under the book supporting means 20 between the bases 90. The U-shape of the base 90 not only provides the apparatus with improved stability, but it also enables books to be stacked and stored between the vertically extending arms 94.

The dismountable engagement means includes a first engagement means 91 in each of the upwardly extending arms 94 of the supporting bases 90, and a second engagement means 52 in each of the book supporting means mounting means 50. The first and second engagement means, 91 and 52 respectively, are mutually engagable for removably joining the bases 90 to the book supporting means mounting means 50. There are numerous dismountable engagement means well known in the art that may be implemented within the scope and spirit of the appended claims. In one preferable embodiment, either the first 91 or the second 52 engagement means consists of several holes, and the other of the first 91 and second 52 engagement means comprises correspondingly placed embossments that fit within the holes so that the bases 90 and supporting means 20 are simply snapped in and out of engagement with one another. The use of a plurality of holes and embossments allows the reader to select the angle of inclination of the support means 20 and book by simply snapping the embossments into other the various available holes which are selected and placed for appropriate angling of the reading matter. This allows the support means 20 to be inclined at an angle appropriate for viewing the book from a seated position, as seen in FIG. 1, and also to be inclined at an even greater angle so that the book 5 can be positioned with the pages in contact with the vertical supporting surface 40, so that the book is easily viewed by a reader whose head is in a low position.

In addition, the dismountable engagement means may also include a lip 130 that extends downwardly from the horizontal supporting surface 30 parallel to the downwardly extending mounting means 50. As best seen in FIG. 1, the distance between the lip 130 and the mounting means 50 is approximately equal to the width of the base arms 94, thus allowing the arms 94 to be slid into position between the mounting means 50 and the lip 130 so as to be more securely engaged with the supporting means 20.

Preferably, the apparatus includes a means 110 for holding a drinking cup (not shown). In one preferred embodiment, illustrated in FIG. 1, the cup holding means 110 is hingably mounted to one of the upwardly extending arms 94 of the bases 90 in such a way that it can be easily pivoted between a first horizontal attitude 112 for holding a cup and a second vertical attitude 114 in which the cup holding means 110 is stored against one of the arms 94 of the base 90. In addition, the apparatus may be used with a reading lamp 120 that can be easily attached or removed from the supporting means 20 when illuminating the book 5 is desired.

Figure 3:
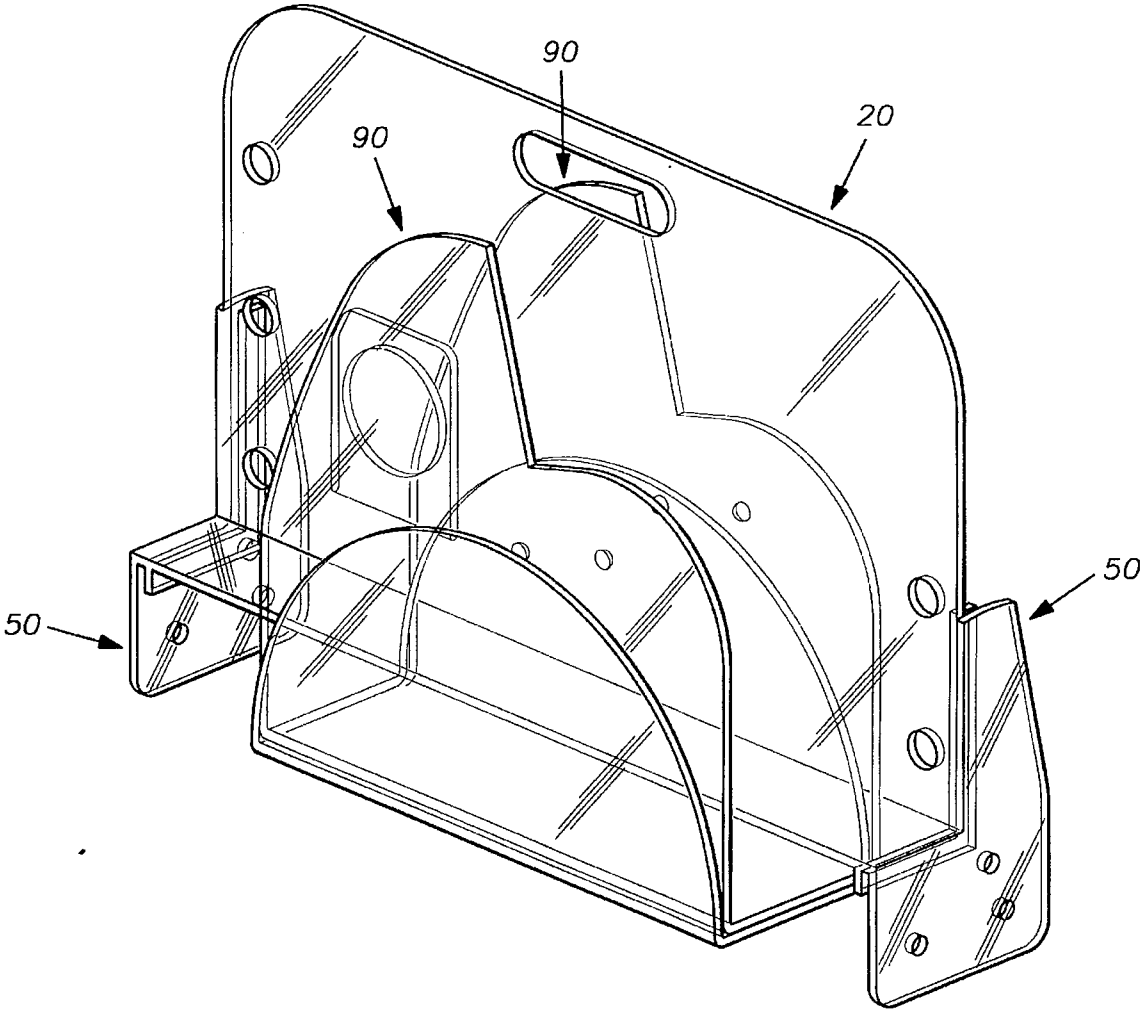
FIG. 3 is a perspective view thereof, particularly showing the apparatus as disassembled and compactly interengaged for storage.

As seen in FIG. 3, the book support apparatus is designed to be easily disassembled and conveniently stacked together into a relatively small, compact configuration in which one of the bases 90 is slid within the vertical arms 94 of the other base 90, and the supporting means 20 is slid within the arms 94 of the nestled bases 90 so that the entire collapsed apparatus is small enough to be stored in a confined area, such as under a bed. In addition, an elongate hole 80 of a size suitable for accepting a hand, is preferably positioned in the vertical supporting surface 40 of the supporting means 20. This allows the supporting means 20 to be easily grasped in a hand and lifted and carried as necessary.

While the invention has been described with reference to at least one preferred embodiment, it is to be clearly understood by those skilled in the art that the invention is not limited thereto. Rather, the scope of the invention is to be interpreted only in conjunction with the following appended claims.

What is claimed is:

1. A book support apparatus comprising:

a means for supporting a book, the supporting means including a first, near horizontal, and a second, near vertical, supporting surfaces for supporting the book;

a pair of means for mounting the book supporting means, the book supporting means mounting means being positioned in a mutually spaced apart relationship each extending downwardly from the near horizontal supporting surface and terminating in a downwardly facing rest edge so that, with the rest edges in contact with a flat support surface, the apparatus is able to support the book with stability on the flat support surface;

the near vertical supporting surface providing a means for holding the book in an open state, and a means for magnifying printed matter of the book to a viewer in front of the book, the apparatus further including a pair of supporting bases, each of the bases being formed from a single sheet, as a U-shape having a flat horizontal portion interconnected to a pair of vertical, spaced apart upwardly extending arms, the bases providing means for dismountable engagement with the book supporting means, such that with the flat horizontal portions of the bases in resting contact with a flat support surface, the book supporting means is positioned above the flat support surface by an amount to allow the torso or legs of a horizontal person resting on the flat support surface to fit comfortably under the book supporting means.

2. The apparatus of claim 1 wherein the book holding means includes at least one pair of horizontally spaced apart first apertures in the near vertical supporting surface and a means for page pressing, the page pressing means laying across the open pages of the book so as to hold the pages open for easier reading, the page pressing means, further, engaged with the spaced apart apertures so as to be held in place on the book.

3. The apparatus of claim 1 wherein the printed matter magnifying means includes a plurality of a pair of spaced apart second apertures in the near vertical supporting surface and an elongate magnifying lens extending between the at least one pair of spaced apart second apertures, and further including a pair of standoffs engaged with one of the pairs of second apertures to hold the magnifying means at an appropriate distance from the printed matter of the book for appropriate magnification of said printed matter to the viewer.

4. The apparatus of claim 3 wherein each one of the standoffs is removably engagable by friction fit, with one of the second apertures, so as to be easily moved from one said aperture to another for adjusting the position of the magnifying means.

5. The apparatus of claim 1 wherein the near vertical surface includes a means for hand gripping for lifting and carrying the apparatus.

6. The apparatus of claim 1 wherein the dismountable engagement means includes a first engagement means in each of the upwardly extending arms of the supporting bases, and a second engagement means in each of the book supporting means mounting means, the first and second engagement means being mutually engagable for removably joining the bases to the book supporting means mounting means.

7. The apparatus of claim 1 wherein one of the first and second engagement means is a plurality of holes, and the other of the first and second engagement means is a correspondingly placed plurality of embossments fitable within the plurality of holes so as to assure snap-in engagement thereof.

8. The apparatus of claim 1 further including a means for holding a drinking cup, the cup holding means being hingably mounted to one of the upwardly extending arms for positioning the cup holding means in a first horizontal attitude for holding the cup, and alternately for positioning the cup holding means in a second vertical attitude for storing the cup holding means.

9. The apparatus of claim 1 wherein the book supporting means, book supporting means mounting means, and the supporting bases are formed and shaped so as to be nested whereby the supporting bases are engagable, one within the other, and further, the book supporting means, and book supporting means mounting means are engagable within the supporting bases, so that the apparatus may be stored compactly.

* * * * *